US010765229B2

(12) United States Patent
Yang

(10) Patent No.: US 10,765,229 B2
(45) Date of Patent: Sep. 8, 2020

(54) EASY-TO-USE FOLDABLE BABY BED FRAME

(71) Applicant: Xiamen baby pretty products Co., Ltd., Xiamen (CN)

(72) Inventor: Jianbo Yang, Xiamen (CN)

(73) Assignee: XIAMEN BABY PRETTY PRODUCTS CO., LTD., Xiamen (CN)

( * ) Notice: Subject to any disclaimer, the term of this patent is extended or adjusted under 35 U.S.C. 154(b) by 515 days.

(21) Appl. No.: 15/721,741

(22) Filed: Sep. 30, 2017

(65) Prior Publication Data

US 2019/0045944 A1 Feb. 14, 2019

(30) Foreign Application Priority Data

Aug. 11, 2017 (CN) ..... 2017 1 0687655

(51) Int. Cl.

| | |
|---|---|
| ***A47D 7/00*** | (2006.01) |
| *A47D 13/06* | (2006.01) |
| *A47D 13/02* | (2006.01) |
| *A47D 9/00* | (2006.01) |

(52) U.S. Cl.

CPC ..... *A47D 7/002* (2013.01); *A47D 7/00* (2013.01); *A47D 7/005* (2013.01); *A47D 9/00* (2013.01); *A47D 9/005* (2013.01); *A47D 13/02* (2013.01); *A47D 13/025* (2013.01); *A47D 13/06* (2013.01)

(58) Field of Classification Search

CPC ..... A47D 7/002; A47D 7/005; A47D 7/00; A47D 13/02; A47D 13/025; A47D 13/06; A47D 13/061; A47D 9/005; A47D 9/00

See application file for complete search history.

(56) References Cited

U.S. PATENT DOCUMENTS

| | | | | |
|---|---|---|---|---|
| 4,934,025 | A * | 6/1990 | Mariol | A47D 13/063 16/347 |
| 7,458,115 | B2 * | 12/2008 | Chen | A47D 7/002 5/93.1 |
| 8,966,680 | B2 * | 3/2015 | Dowd | A47D 13/063 5/98.1 |
| 2008/0000023 | A1 * | 1/2008 | Chen | A47D 13/063 5/99.1 |

(Continued)

FOREIGN PATENT DOCUMENTS

| | | |
|---|---|---|
| CN | 104305769 A | 1/2015 |
| GB | 2118032 A | 10/1983 |

*Primary Examiner* — Robert G Santos
*Assistant Examiner* — Rahib T Zaman
(74) *Attorney, Agent, or Firm* — Bayramoglu Law Offices LLC

(57) ABSTRACT

An easy-to-use foldable baby bed frame, including two connecting portions, two first support rods, two second support rods, first rotating rods and second rotating rods. The left and right ends of each connecting portion are respectively provided with a left hinge portion and a right hinge portion. The inner and outer end surfaces of the left hinge portion are provided with the first left rotating portion and the second left rotating portion. The inner and outer end surfaces of the right hinge portion are provided with the first right rotating portion and the second right rotating portion. The two ends of the first rotating rods are respectively connected to the left ends of the second left rotating portion. The two ends of the second rotating rods are respectively connected to the right ends of the two second right rotating portion.

6 Claims, 7 Drawing Sheets

(56) References Cited

U.S. PATENT DOCUMENTS

| | | | | |
|---|---|---|---|---|
| 2012/0233770 | A1* | 9/2012 | Greger | A47D 9/00 5/98.1 |
| 2015/0196135 | A1* | 7/2015 | Longenecker | A47D 13/063 403/53 |
| 2015/0342365 | A1* | 12/2015 | Corso | A47D 9/00 5/102 |
| 2016/0108655 | A1* | 4/2016 | Jones | A47D 7/002 16/319 |
| 2016/0309914 | A1* | 10/2016 | Burns | A47D 9/005 |
| 2017/0172311 | A1* | 6/2017 | Longenecker | F16B 7/00 |
| 2017/0196373 | A1* | 7/2017 | Sclare | A47D 5/00 |
| 2017/0360216 | A1* | 12/2017 | Sclare | A47D 9/02 |
| 2018/0146795 | A1* | 5/2018 | Longenecker | A47D 7/01 |
| 2018/0146796 | A1* | 5/2018 | Longenecker | A47D 13/063 |

* cited by examiner

EASY-TO-USE FOLDABLE BABY BED FRAME

CROSS REFERENCE TO RELATED APPLICATION

This application is based upon and claims priority to Chinese Patent Application No. 201710687655.4, filed on Aug. 11, 2017, the entire contents of which are incorporated herein by reference.

TECHNICAL FIELD

The present invention relates to the field of baby products, particularly to an easy-to-use foldable baby bed frame.

BACKGROUND

The baby bed is the bed used for infants and young children. Usually, the baby's sleep time is relatively long. Sufficient quality sleep plays a vital role in the growth and development of the baby. Thus, in order to ensure that the baby's sleeping environment is safe and comfortable, the selection and arrangement of the baby bed become particularly important. With the development of technology, the style of the baby bed varies. The function and price also differ greatly. The current baby bed mainly includes a bed frame and bedrail. However, the bed frame and bedrail cannot be folded. During installation, multiple parts need to be assembled. Moreover, it is hard to move, which is inconvenient to the user.

SUMMARY OF THE INVENTION

The present invention provides an easy-to-use foldable baby bed frame. The object of the present invention is to overcome the problem that the existing baby bed cannot be folded.

In order to solve the above technical problem, the present invention uses the technical solutions as below:

An easy-to-use foldable baby bed frame includes two connecting portions, two first support rods, two second support rods, a first rotating rod, and a second rotating rod. The two connecting portions are laid out in a front-and-rear manner. The left and right ends of each connecting portions are provided with a left hinge portion and a right hinge portion respectively. The outer and inner end surfaces of the left hinge portion are respectively provided with a first left rotating portion and a second left rotating portion that are hinged to the left hinge portion. The outer and inner end surfaces of the right hinge portion are respectively provided with a first right rotating portion and a second right rotating portion that are hinged to the right hinge portion. The first left rotating portion and the first right rotating portion are driven to rotate respectively by the second left rotating portion and the second right rotating portion. The connecting portion is provided with stretchable left and right snap-in portions; the first left rotating portion and the second left rotating portion can fit the left snap-in portion. The first right rotating portion and the second right rotating portion fit the right snap-in portion. The two first support rods are respectively connected to the bottom ends of the first left rotating portion of the two connecting portions. The two second support rods are respectively connected to the bottom ends of the first right rotating portion in the two connecting portions. The first rotating rod and the second rotating rod are both U-shaped. Two ends of the first rotating rod are respectively connected to the left ends of the second left rotating portion of the two connecting portions. The two ends of the second rotating rods are connected to the right ends of the second right rotating portion in the two connecting portions.

The right end of the left hinge portion and the left end of the right hinge portion are provided with a left snap-in slot and a right snap-in slot. The left snap-in slot and the right snap-in slot fit the left snap-in portion and the right snap-in portion. The width of the left snap-in portion and the width of the right snap-in portion are greater than the width of the left snap-in slot and the width of the right snap-in slot respectively. The front and rear ends of each of the left snap-in portion and the right snap-in portion extend beyond the left snap-in slot and the right snap-in slot respectively. Each of the first left rotating portion and the first right rotating portion is provided with a first snap-in slot. Each of the second left rotating portion and the second right rotating portion is provided with a second snap-in slot. The first snap-in slot of the first left rotating portion and the second snap-in slot of the second left rotating portion both fit the left snap-in portion. The first snap-in slot of the first right rotating portion and the second snap-in slot of the second right rotating portion both fit the right snap-in portion.

The left hinge portion and the right hinge portion are respectively provided with a left arc through groove and a right arc through groove. The inner end surface of the first left rotating portion and the inner end surface of the first right rotating portion are respectively provided with a left arc groove and a right arc groove that directly correspond to the left arc through groove and the right arc through groove. The arc length of the left arc groove and the arc length of the right arc groove are less than the arc length of the left arc through groove and the arc length of the right arc through groove respectively. The outer end surface of the second left rotating portion and the outer end face of the second right rotating portion are respectively provided with a left rotating rod and a right rotating rod. One end of the left rotating rod and one end of the right rotating rod respectively pass through the left arc through groove and the right arc through groove and are located inside the left arc groove and the right arc groove.

The connecting portion is provided with an internally hollow pressing member. The bottom end of the pressing member extends outside the bottom surface of the connecting portion. The inner middle portion of the pressing member is provided with a support column. The middle portion of the support column is provided with an accommodating hole. A spring is provided between the accommodating hole and the inner top surface of the connecting portion. The inner and outer end surfaces of the pressing member are provided with a first inclined through groove and a second inclined through groove. The first inclined through groove is arranged symmetrically with respect to the second inclined through groove. The center line in the longitudinal direction of the first inclined through groove and the center line in the longitudinal direction of the second inclined through groove intersect and form a "V" shape. The left and right ends of the pressing member are respectively provided with a left connecting member and a right connecting member arranged in a symmetrical manner. Each of the left connecting member and the right connecting member has a sideways U-shape. The left snap-in portion and the right snap-in portion are connected to the middle portion of the left connecting member and a middle portion of the right connecting member respectively. A left rotating shaft is inserted between the first inclined through groove on the inner and outer end surfaces of the pressing member. Both ends of the left rotating shaft penetrate the corresponding first inclined grooves and are connected to both ends of the left connecting member respectively. A right rotating shaft is inserted between the second inclined through groove on the inner and outer end surfaces of the pressing member. Both ends of the right rotating shaft penetrate the corresponding second inclined grooves and are connected to both ends of the right connecting member respectively.

Each of the two first support rods includes a first upper support rod and a first lower support rod. The bottom portion of the first upper support rod is hinged to the top portion of the first lower support rod. Each of the two second support rods includes a second upper support rod and a second lower support rod. The bottom portion of the second upper support rod is hinged to the top portion of the second lower support rod.

The bottom of the first upper support rod is provided with a left extending end portion which is oriented rightward. The left end of the left extension end portion is provided with a left notch. A first elastic member is provided inside the upper portion of the first lower support rod. The top end of the first elastic member extends beyond the first lower support rod. The right end surface of the first elastic member is provided with a left snap-in step which snaps in the left notch. The top portion of the first lower support rod is provided with a left hinge part hinged to the left extending end portion. A first upper connecting rod is provided between the left extending end portions of the two upper support rods. A first lower connecting rod is provided between the bottom portions of the two first lower support rods. The bottom portion of the second upper support rod is provided with an extended right end portion which is oriented leftward. The right end of the right extending end is provided with a right notch. A second elastic member is provided on the upper portion of the second lower support rod. The top end of the second elastic member extends beyond the second lower support rod. The right end surface of the second elastic member is provided with a right snap-in step which snaps in the right notch. The top portion of the second lower support rod is provided with a right hinge part hinged to the right extending end portion. The second upper connecting rod is provided between the right extending end portions of the two second upper support rods. The second lower connecting rod is provided between the bottom portions of the two second lower support rods. The inner side surface of the first lower support rod and the inner side surface of the second lower support rod are provided with a first driving member and a second driving member that drive the first elastic member and the second elastic member to compress respectively.

It can be seen from the above description of the present invention, compared to the prior art, the present invention has the following advantages. The present invention has a novel structure and a clever design. When in use, the first rotating rod and the second rotating rod in the folded state rotate upward. While the first rotating rod and the second rotating rod are rotating upward, the first left rotating portion and the first right rotating portion are driven to rotate by the second left rotating portion and the second right rotating portion respectively. Accordingly, the first support rod and the second support rod are driven to unfold leftward and rightward respectively. When the second left rotating portion, the first left rotating portion, the second right rotating portion, and the first right rotating portion rotate in position, the second left rotating portion and the first left rotating portion snap in the left snap-in portion. Also, the second right rotating portion and the first right rotating portion snap in the right snap-in portion. Accordingly, the first rotating rod, the second rotating rod, the first support rod, and the second support rod are unfolded and fixed to form a bed frame. Then, the bedrail made of cloth can be installed, such that a baby bed is ready for use. When the bed frame is to be stored up, the left snap-in portion and the right snap-in portion are drawn back, such that the first left rotating portion and the second left rotating portion are separated from the left snap-in portion. Also, the first right rotating portion and the second right rotating portion are separated from the right snap-in portion. At this point, the first rotating rod and the second rotating rod can rotate to be folded downward. At the same time, the first left rotating portion and the first rotating portion is driven to rotate by the second left rotating portion and the second rotating portion, such that the first support rod and the second support rod close up. The present invention can realize the rapid unfolding and folding of the baby bed frame. The present invention is easy to use and operate. After purchase, it is unnecessary to assemble the baby bed frame by the user. Moreover, the present invention is easy to carry and move.

DETAILED DESCRIPTION OF THE EMBODIMENTS

Figure 1:
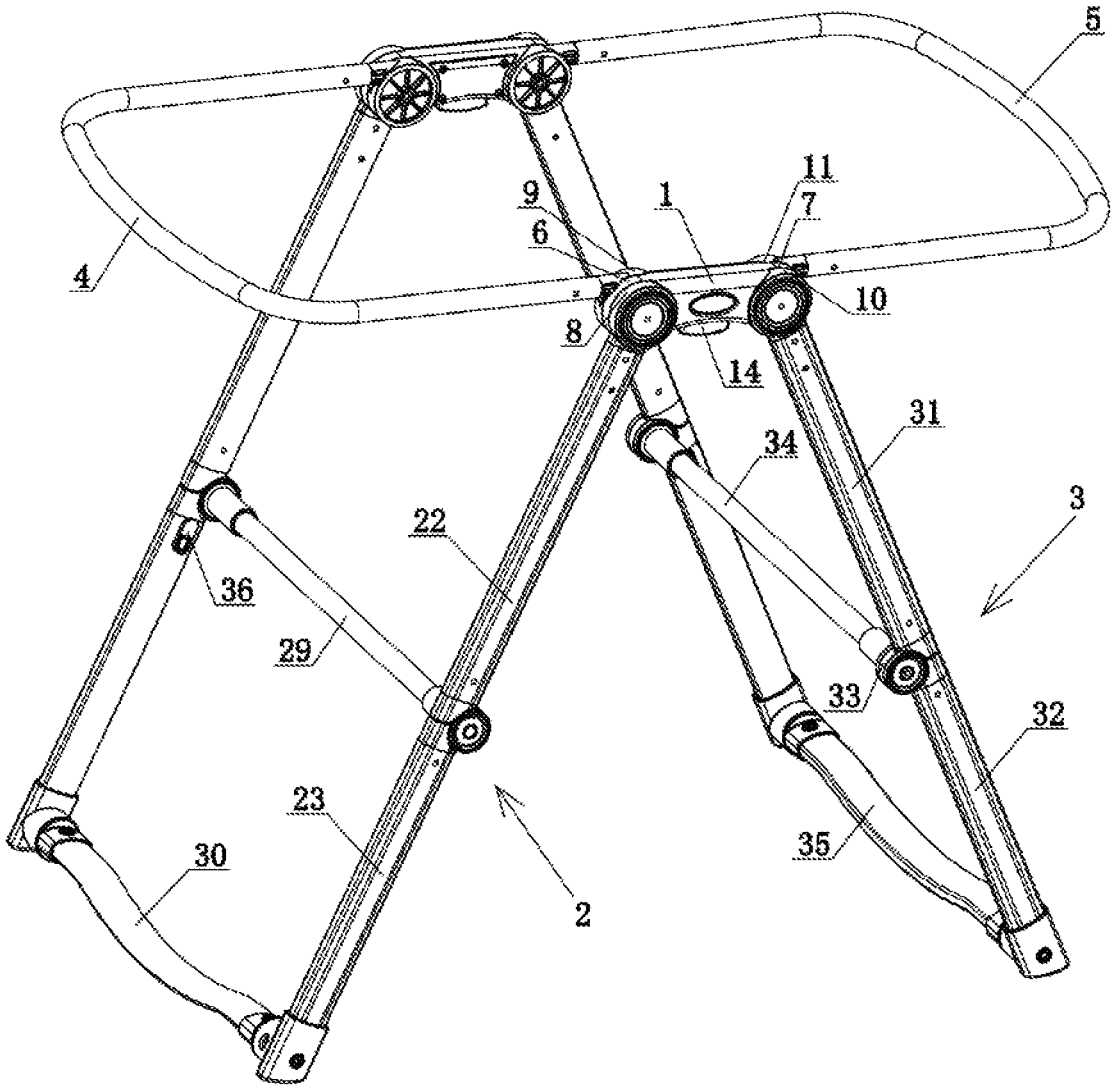
FIG. 1 is a structural view of the present invention.
Figure 2:
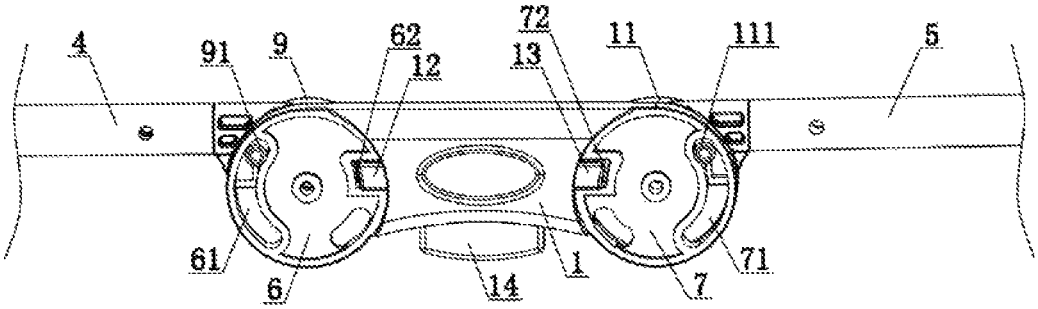
FIG. 2 is a structural view showing the connecting portion of the present invention after the first left rotating portion and the first right rotating portion are removed.

Referring to FIG. 1 and FIG. 2, an easy-to-use foldable baby bed frame includes two connecting portions 1, two first support rods 2, two second support rods 3, first rotating rod 4, and second rotating rod 5. Two connecting portions 1 are laid out in a front-and-rear manner. The left and right ends of each connecting portion 1 are provided with left hinge portion 6 and right hinge portion 7 respectively. The outer and inner end surfaces of left hinge portion 6 are respectively provided with first left rotating portion 8 and second left rotating portion 9 that are hinged to the left hinge portion 6. The outer and inner end surfaces of right hinge portion 7 are respectively provided with first right rotating portion 10 and second right rotating portion 11 that are hinged to the right hinge portion 7. First left rotating portion 8 and first right rotating portion 10 are driven to rotate respectively by second left rotating portion 9 and second right rotating portion 11. Connecting portion 1 is provided with stretchable left and right snap-in portions 12, 13. First left rotating portion 8 and second left rotating portion 9 both can fit left snap-in portion 12. First right rotating portion 10 and second right rotating portion 11 both can fit right snap-in portion 13. Two first support rods 2 are respectively connected to the bottom end of first left rotating portion 8 of two connecting portions 1. Two second support rods 3 are respectively connected to the bottom end of first right rotating portion 10 of two connecting portions 1. First rotating rod 4 and second rotating rod 5 are both U-shaped. Two ends of first rotating rod 4 are respectively connected to the left end of second left rotating portion 9 of two connecting portions 1. Two ends of second rotating rods 5 are respectively connected to the right end of second right rotating portion 11 of two connecting portions 1.

Referring to FIG. 1 to FIG. 4, left hinge portion 6 and right hinge portion 7 are respectively provided with left arc through groove 61 and right arc through groove 71. The inner end surface of first left rotating portion 8 and the inner end surface of first right rotating portion 10 are respectively provided with left arc groove 81 and right arc groove (not shown) that are directly corresponding to left arc through groove 61 and right arc through groove 71. The arc length of left arc groove 81 and a right arc groove (not shown) are smaller than the arc length of left arc through groove 61 and right arc through groove 71 respectively. The outer end surface of second left rotating portion 9 and the outer end face of second right rotating portion 11 are respectively provided with left rotating rod 91 and right rotating rod 111. One end of left rotating rod 91 and one end of right rotating rod 111 respectively pass through left arc through groove 61 and right arc through groove 71 and are located inside left arc groove 81 and the right arc groove (not shown in the Figure).

Figure 3:
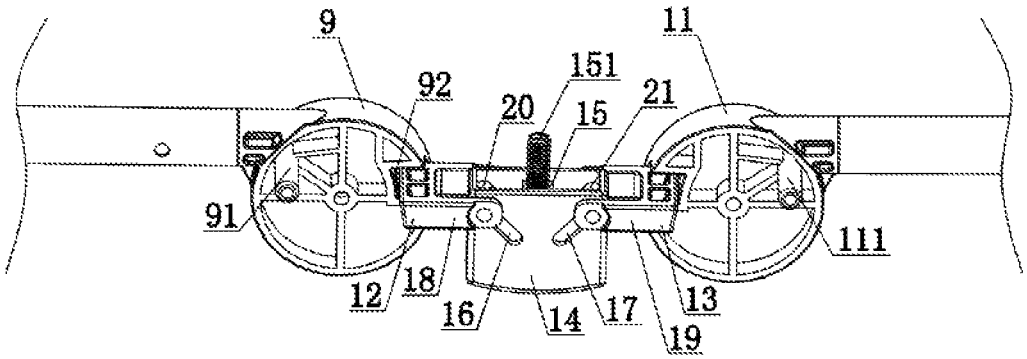
FIG. 3 is a structural view showing the structure of FIG. 2 after the connecting portion is removed.
Figure 4:
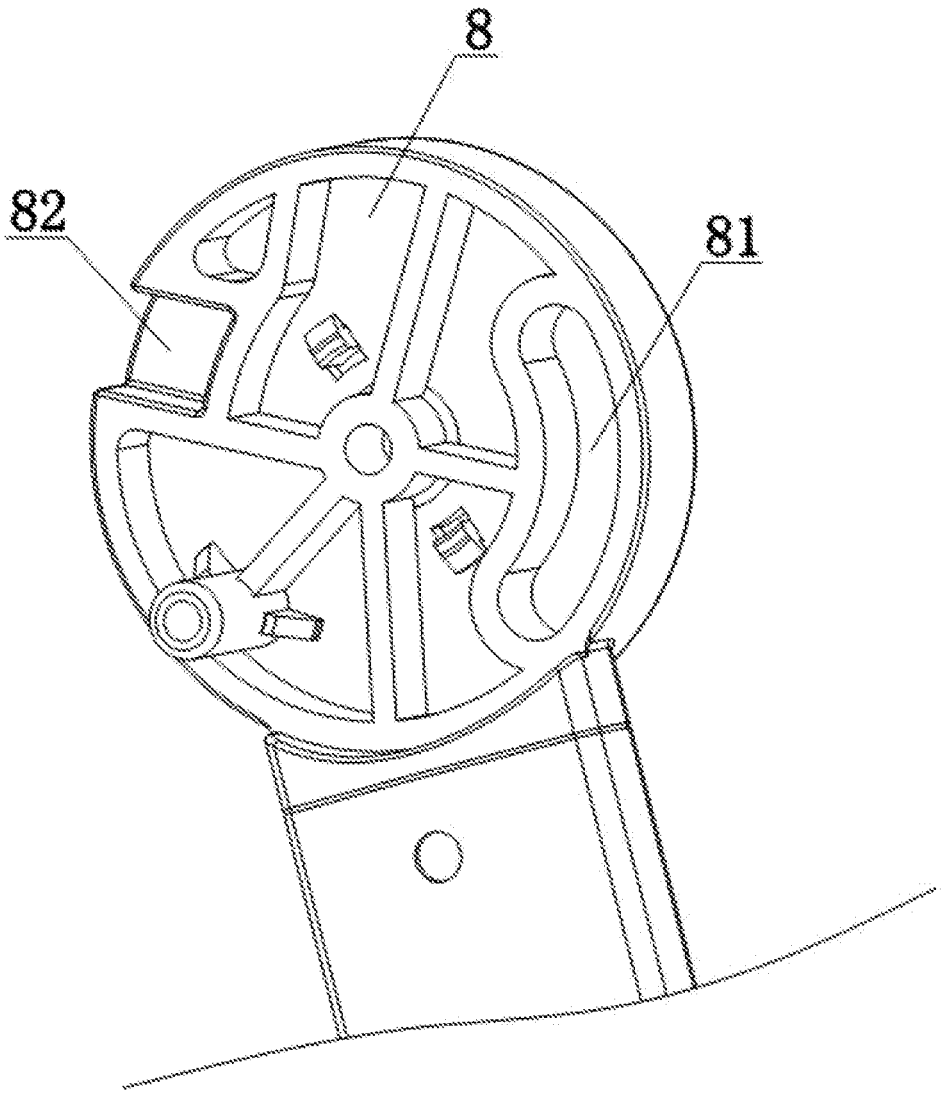
FIG. 4 is a structural view of the first left rotating portion of the present invention.

Referring to FIG. 2 to FIG. 4, the right end of left hinge portion 6 and the left end of right hinge portion 7 are respectively provided with left snap-in slot 62 and right snap-in slot 72. Left snap-in slot 62 and right snap-in slot 72 fit left snap-in portion 12 and right snap-in portion 13 respectively. The width of left snap-in portion 12 and the width of right snap-in portion 13 are greater than the width of left snap-in slot 62 and the width of right snap-in slot 72 respectively. The front and rear ends of each of left snap-in portion 12 and right snap-in portion 13 extend beyond left snap-in slot 62 and right snap-in slot 72 respectively. Each of first left rotating portion 8 and first right rotating portion 10 is provided with first snap-in slot 82. Each of second left rotating portion 9 and second right rotating portion 11 is provided with second snap-in slot 92. First snap-in slot 82 of first left rotating portion 8 and second snap-in slot 92 of second left rotating portion 9 both fit left snap-in portion 12. First snap-in slot 82 of first right rotating portion 10 and second snap-in slot 92 of second right rotating portion 11 both fit right snap-in portion 13.

Referring to FIG. 1 to FIG. 4, connecting portion 1 is provided with internally hollow pressing member 14. The bottom end of pressing member 14 extends outside the bottom surface of connecting portion 1. The inner middle portion of pressing member 14 is provided with support column 15. The middle portion of support column 15 is provided with an accommodating hole (which is not labeled in the drawings). Spring 151 is provided between the accommodating hole (which is not labeled in the drawings) and the inner top surface of connecting portion 1. The inner and outer end faces of pressing member 14 are provided with fast inclined through groove 16 and second inclined through groove 17. First inclined through groove 16 is arranged symmetrically with respect to second inclined through groove 17. The center line in the longitudinal direction of first inclined through groove 16 and the center line in the longitudinal direction of second inclined through groove 17 intersect and form a "V" shape. The left and right ends of pressing member 14 are provided with left connecting member 18 and right connecting member 19 that are symmetrically arranged. Each of left connecting member 18 and right connecting member 19 has a sideways U-shape. Left snap-in portion 12 and right snap-in portion 13 are connected to the middle portion of left connecting member 18 and the middle portion of right connecting member 19 respectively. Left rotating shaft 20 is inserted between first inclined through groove 16 on the inner and outer end surfaces of pressing member 14. Both ends of left rotating shaft 20 penetrate the corresponding first inclined groove 16 and are connected to both ends of left connecting member 18 respectively. Right rotating shaft 21 is inserted between second inclined through groove 17 on the inner and outer end surfaces of pressing member 14. Both ends of right rotating shaft 21 penetrate the corresponding second inclined groove 17 and are connected to both ends of right connecting member 19 respectively.

Referring to FIG. 1, each of the two first support rods 2 includes first upper support rod 22 and first lower support rod 23. The bottom portion of first upper support rod 22 is hinged to the top portion of first lower support rod 23. Each of the two second support rods 3 includes second upper support rod 31 and second lower support rod 32. The bottom portion of second upper support rod 31 is hinged to the top portion of second lower support rod 32.

Referring to FIG. 1, FIG. 5, FIG. 6, and FIG. 7, the bottom of first upper support rod 22 is provided with left extending end portion 24 which is oriented rightward. The left end of left extension end portion 24 is provided with left notch 25. First elastic member 26 is provided on the upper portion of first lower support rod 23. The top end of first elastic member 26 extends beyond first lower support rod 23. The right end surface of first elastic member 26 is provided with left snap-in step 27 which can snap in left notch 25. The top portion of first lower support rod 23 is provided with left hinge part 28 hinged to left extending end portion 24. First upper connecting rod 29 is provided between left extending end portions 24 of two upper support rods 22. First lower connecting rod 30 is provided between the bottom portions of two first lower support rods 23.

Figure 5:
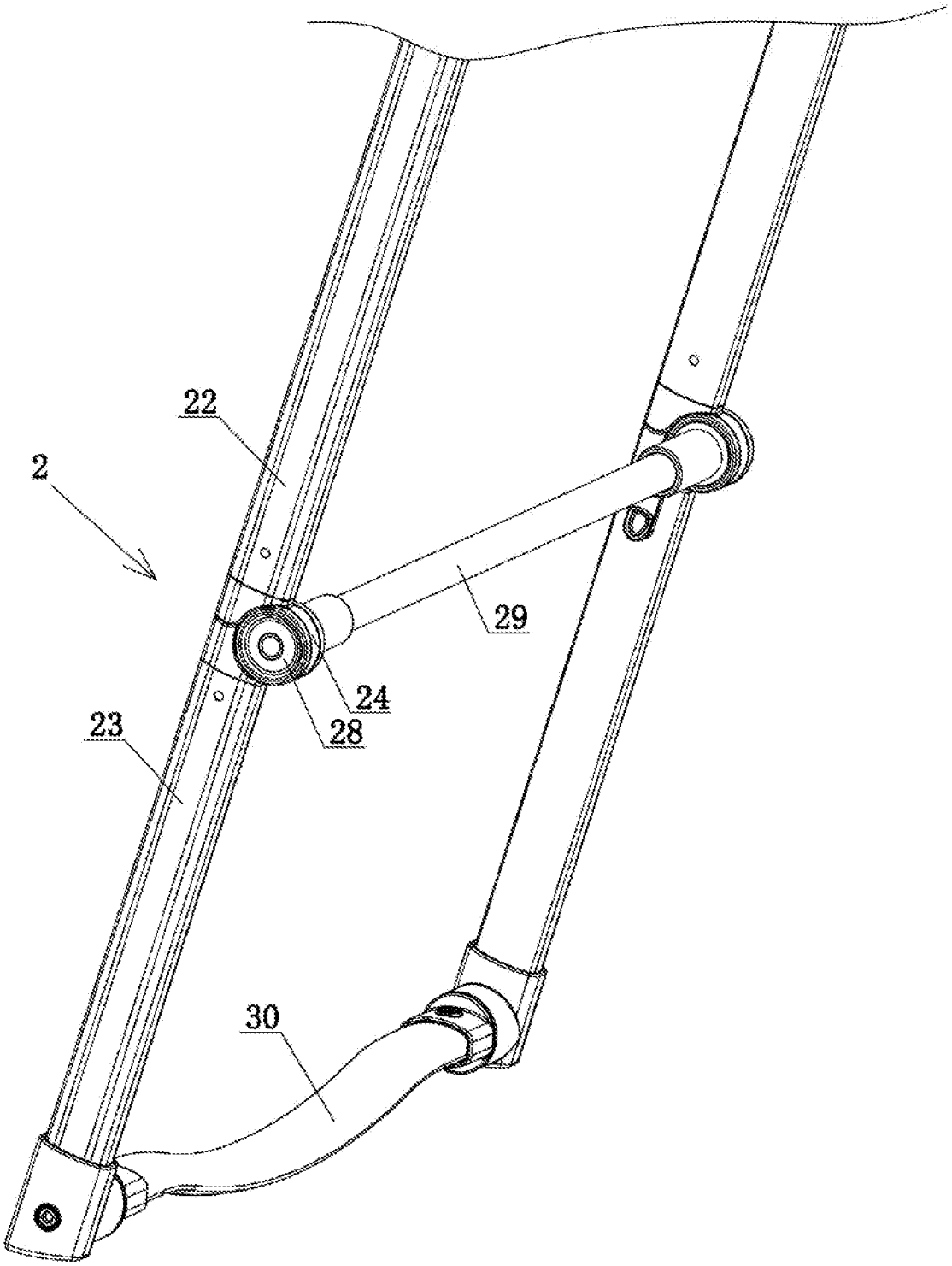
FIG. 5 is a structural view of the two first support rods of the present invention.
Figure 6:
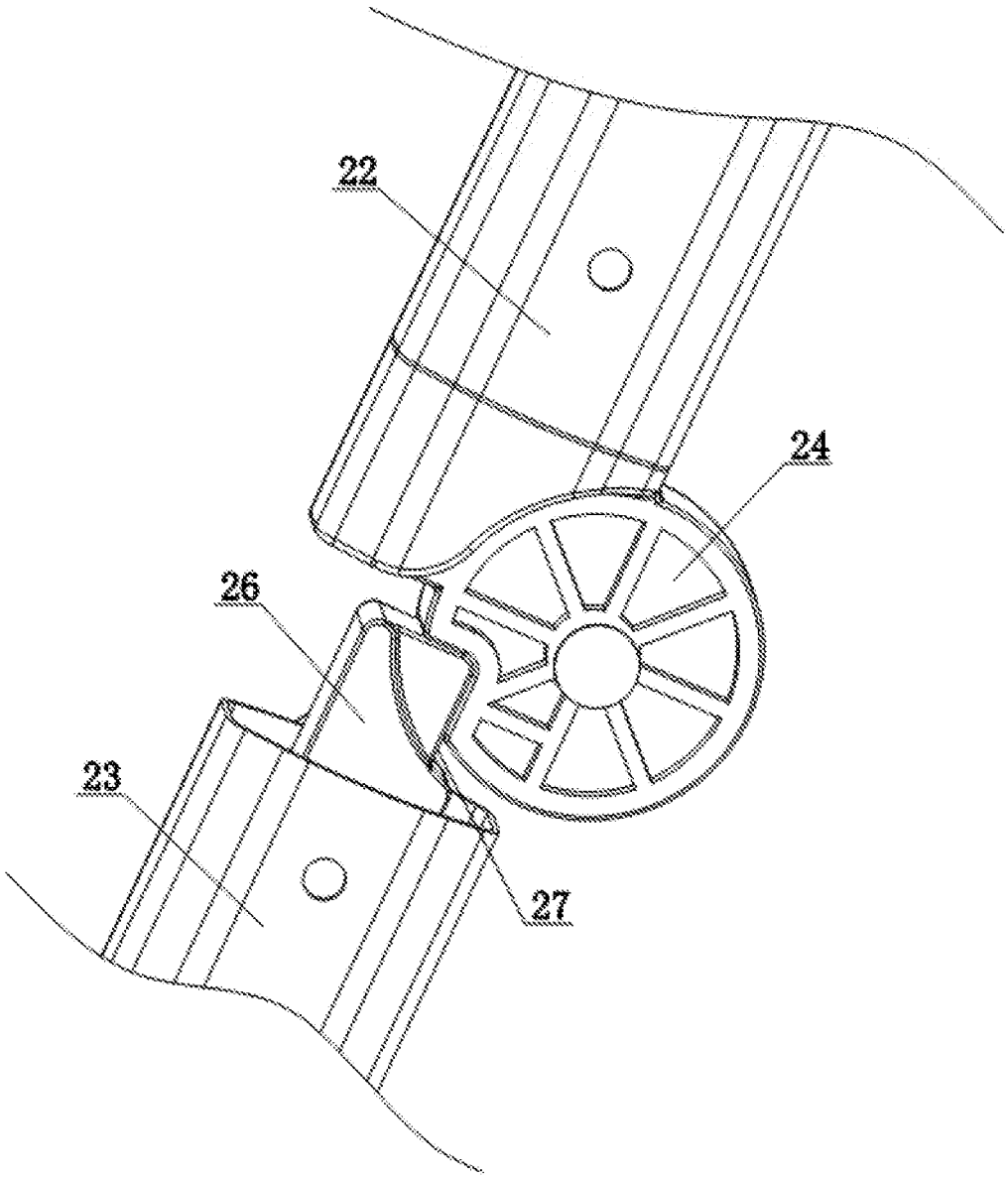
FIG. 6 is a view showing the fitting of the left extending end portion and the first elastic member of the present invention.
Figure 7:
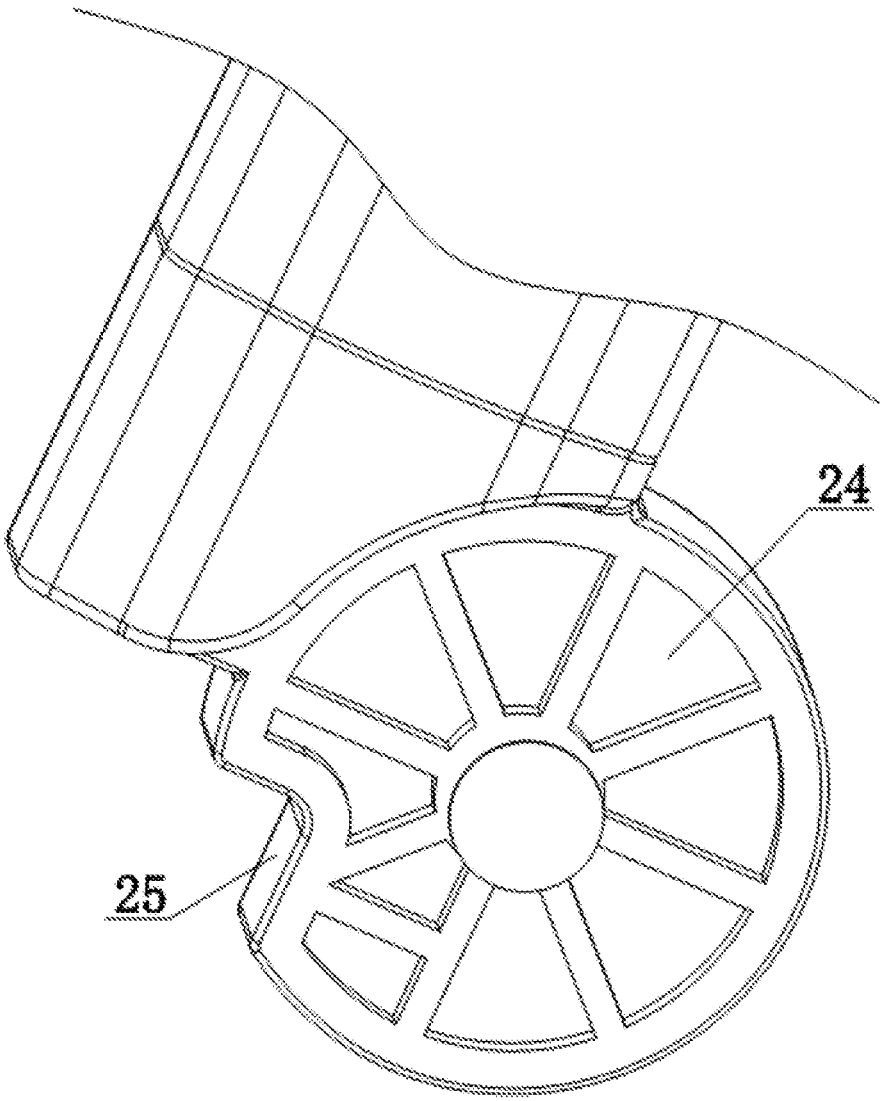
FIG. 7 is a structural view of the left extending end portion of the present invention.
Figure 8:
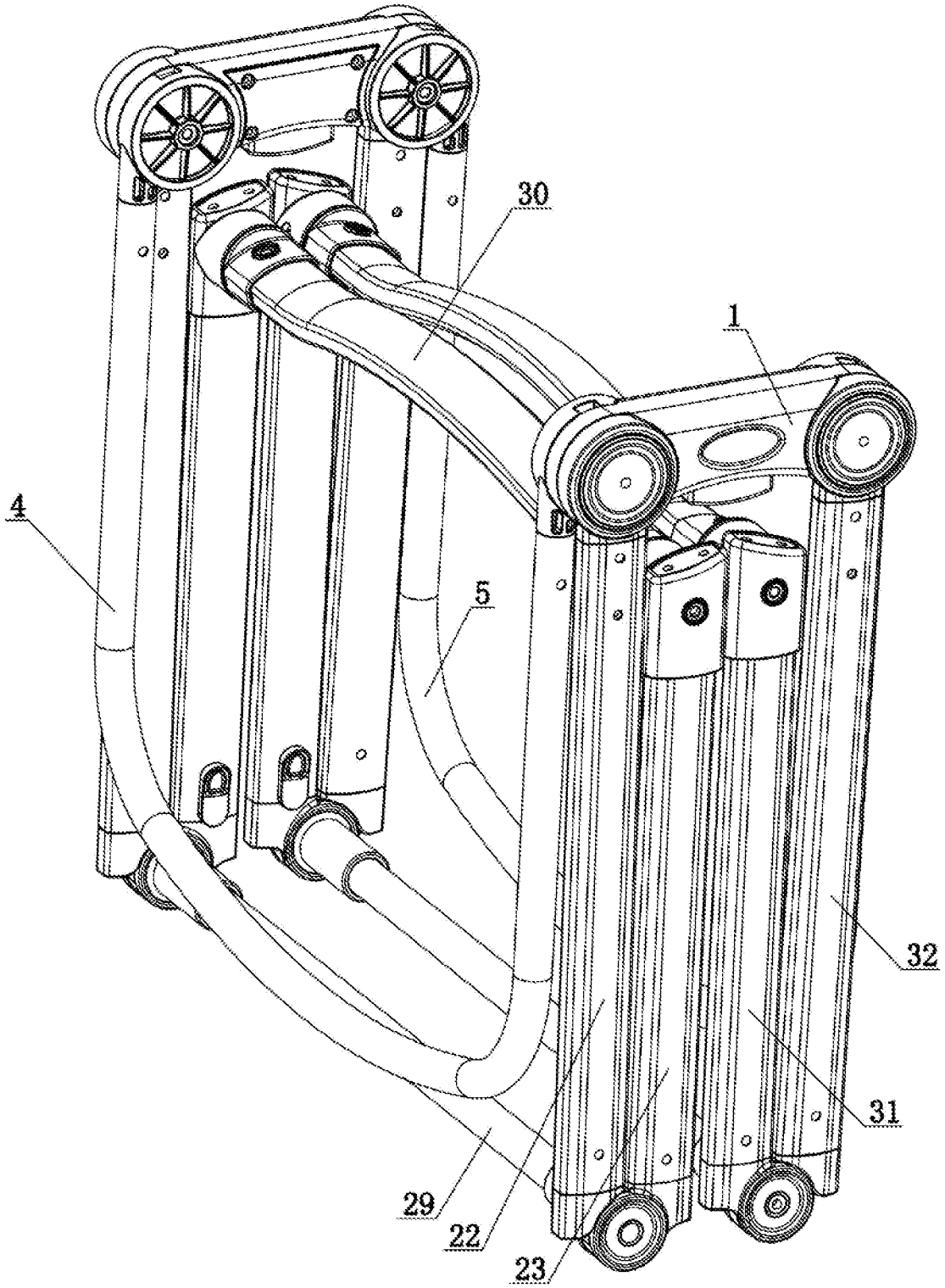
FIG. 8 is a view showing a folded structure of the present invention.

Referring to FIG. 1 and FIG. 5, the structures of second upper support rod 31 and second lower support rod 32 are the same as those of first upper support rod 22 and first lower support rod 23 respectively. The bottom portion of second upper support rod 31 is provided with extended right end portion 33 which is oriented leftward. The right end of right extending end 33 is provided with a right notch. A second elastic member is provided on the upper portion of second lower support rod 32. The top end of the second elastic member extends beyond second lower support rod 32. The left end surface of the second elastic member is provided with the right snap-in step which can snap in the right notch. The top portion of second lower support rod 32 is provided with a right hinge part hinged to right extending end portion 33. Second upper connecting rod 34 is provided between right extending end portions 33 of two upper support rods 31. Second lower connecting rod 35 is provided between the bottom portions of two second lower support rods 32. The inner side surface of first lower support rod 23 and the inner side surface of second lower support rod 32 are provided with first driving member 36 and a second driving member that drive first elastic member 26 and the second elastic member to compress respectively. The structure of first driving member 36 is the same as that of the second driving member.

Referring to FIGS. 1 to FIG. 8, the design principle of the present invention is as follows. When the present invention is used, first rotating rod 4 and second rotating rod 5 in the folded state rotate upward. The arc length of left arc groove 81 and the arc length of the right arc groove (not shown) are less than the arc length of left arc through groove 61 and the arc length of right arc through groove 71 respectively. Thus, while first rotating rod 4 and second rotating rod 5 rotate upward to reach a certain angle, first left rotating portion 8 and first right rotating portion 10 are driven to rotate by second left rotating portion 9 and second right rotating portion 11 respectively. Accordingly, first support rod 2 and second support rod 3 are driven to be unfolded leftward and rightward respectively. When second left rotating portion 9, first left rotating portion 8, second right rotating portion 11, and first right rotating portion 10 rotate in position, first snap-in slot 82 of first left rotating portion 8 and second snap-in slot 92 of second left rotating portion 9 fit left snap-in portion 12. First snap-in slot 82 of first right rotating portion 10 and second snap-in slot 92 of second right rotating portion 11 fit right snap-in portion 13. Accordingly, first rotating rod 4, second rotating rod 5, first support rod 2, and second support rod 3 are unfolded and fixed to form a bed frame. Then, the bedrail made of cloth can be installed, such that a baby bed is ready for use. When the bed frame is to be stored up, pressing member 14 is pressed upward. At this time, left rotating shaft 20 and right rotating shaft 21 move leftward and rightward along first inclined groove 16 and second inclined groove 17 respectively, such that left snap-in portion 12 and right snap-in portion 13 are driven to retract. Accordingly, first snap-in slot 82 of first left rotating portion 8 and second snap-in slot 92 of second left rotating portion 9 are separated from left snap-in portion 12. First snap-in slot 82 of first right rotating portion 10 and second snap-in slot 92 of second right rotating portion 11 are separated from right snap-in portion 13. At this time, first rotating rod 4 and second rotating rod 5 can rotate downward to be folded. At the same time, first left rotating portion 8 and first right rotating portion 10 are driven to rotate by second left rotating portion 9 and second right rotating portion 11, such that first support rod 2 and second support rod 3 close up. First support rod 2 and second support rod 3 can be folded. First support rod 2 is taken as an example, first driving member 36 slides downward to separate left notch 25 of first elastic member 26 from left snap-in step 27. At this time, first left upper support rod 22 and first lower support rod 23 can rotate to be folded. When first lower support rod 23 rotates reversely, first upper support rod 22 and first lower support rod 23 are unfolded. At this time, left snap-in step 27 snaps in left notch 25.

The above are merely specific embodiments of the present invention. However, the design concept of the present invention is not limited thereto. Any modification using the design concept without substantially changing the present invention should be conceived as an infringement of the scope of the present invention.

What is claimed is:

1. An easy-to-use foldable baby bed frame, comprising two connecting portions, two first support rods, two second support rods, a first rotating rod, and a second rotating rod;

wherein the two connecting portions are laid out in a front-and-rear manner;

left and right ends of each connecting portion of the two connection portions are provided with a left hinge portion and a right hinge portion respectively;

outer and inner end surfaces of the left hinge portion of a left connecting portion of the two connecting portions are respectively provided with a first left rotating portion and a second left rotating portion that are hinged to the left hinge portion of the left connecting portion of the two connecting portions;

outer and inner end surfaces of the right hinge portion of a right connecting portion of the two connecting portions are respectively provided with a first right rotating portion and a second right rotating portion that are hinged to the right hinge portion of the right connecting portion of the two connecting portions;

the first left rotating portion and the first right rotating portion are driven to rotate respectively by the second left rotating portion and the second right rotating portion;

the each connecting portion of the two connecting portions is provided with stretchable left and right snap-in portions;

the first left rotating portion and the second left rotating portion fit the left snap-in portion of the left connecting portion of the two connecting portions;

the first right rotating portion and the second right rotating portion fit the right snap-in portion of the right connecting portion of the two connecting portions;

the two first support rods are respectively connected to a bottom end of the first left rotating portion of the each connecting portion of the two connecting portions;

the two second support rods are respectively connected to a bottom end of the first right rotating portion of the each connecting portion of the two connecting portions;

the first rotating rod and the second rotating rod are both U-shaped;

two ends of the first rotating rod are respectively connected to a left end of the second left rotating portion of the each connecting portion of the two connecting portions; and the two ends of the second rotating rods are connected to a right end of the second right rotating portion of the each connecting portion of the two connecting portions.

2. The easy-to-use foldable baby bed frame according to claim 1, wherein a right end of the left hinge portion of the left connecting portion of the two connecting portions and a left end of the right hinge portion of the right connecting portion of the two connecting portions are provided with a left snap-in slot of the left connecting portion of the two connecting portions and a right snap-in slot of the right connecting portion of the two connecting portions respectively;

the left snap-in slot of the left connecting portion of the two connecting portions and the right snap-in slot of the right connecting portion of the two connecting portions fit the left snap-in portion of the left connecting portion of the two connecting portions and the right snap-in portion of the right connecting portion of the two connecting portions;

a width of the left snap-in portion of the left connecting portion of the two connecting portions and a width of the right snap-in portion of the right connecting portion of the two connecting portions are greater than a width of the left snap-in slot of the left connecting portion of the two connecting portions and a width of the right snap-in slot of the right connecting portion of the two connecting portions respectively;

front and rear ends of each of the left snap-in portion of the left connecting portion of the two connecting portions and the right snap-in portion of the right connecting portion of the two connecting portions extend beyond the left snap-in slot of the left connecting portion of the two connecting portions and the right snap-in slot of the right connecting portion of the two connecting portions respectively;

each of the first left rotating portion and the first right rotating portion is provided with a first snap-in slot;

each of the second left rotating portion and the second right rotating portion is provided with a second snap-in slot;

the first snap-in slot of the first left rotating portion and the second snap-in slot of the second left rotating portion both fit the left snap-in portion of the left connecting portion of the two connecting portions; and the first snap-in slot of the first right rotating portion and the second snap-in slot of the second right rotating portion both fit the right snap-in portion of the right connecting portion of the two connecting portions.

3. The easy-to-use foldable baby bed frame according to claim 1, wherein the left hinge portion of the left connecting portion of the two connecting portions and the right hinge portion of the right connecting portion of the two connecting portions are respectively provided with a left arc through groove of the left connecting portion of the two connecting portions and a right arc through groove of the right connecting portion of the two connecting portions;

an inner end surface of the first left rotating portion and an inner end surface of the first right rotating portion are respectively provided with a left arc groove of the left connecting portion of the two connecting portions and a right arc groove of the right connecting portion of the two connecting portions;

the left arc groove of the left connecting portion of the two connecting portions and the right arc groove of the right connecting portion of the two connecting portions directly correspond to the left arc through groove of the left connecting portion of the two connecting portions and the right arc through groove of the right connecting portion of the two connecting portions;

an arc length of the left arc groove of the left connecting portion of the two connecting portions and an arc length of the right arc groove of the right connecting portion of the two connecting portions are less than an arc length of the left arc through groove of the left connecting portion of the two connecting portions and an arc length of the right arc through groove of the right connecting portion of the two connecting portions respectively;

an outer end surface of the second left rotating portion and an outer end face of the second right rotating portion are respectively provided with a left rotating rod and a right rotating rod; and one end of the left rotating rod and one end of the right rotating rod respectively pass through the left arc through groove of the left connecting portion of the two connecting portions and the right arc through groove of the right connecting portion of the two connecting portions and are located inside the left arc groove of the left connecting portion of the two connecting portions and the right arc groove of the right connecting portion of the two connecting portions.

4. The easy-to-use foldable baby bed frame according to claim 1, wherein the each connecting portion of the two connection portions is provided with an internally hollow pressing member;

a bottom end of the pressing member extends outside a bottom surface of the each connecting portion of the two connection portions;

an inner middle portion of the pressing member is provided with a support column;

a middle portion of the support column is provided with an accommodating hole;

a spring is provided between the accommodating hole and an inner top surface of the each connecting portion of the two connection portions;

inner and outer end surfaces of the pressing member are provided with a first inclined through groove and a second inclined through groove;

the first inclined through groove is arranged symmetrically with respect to the second inclined through groove;

a center line in a longitudinal direction of the first inclined through groove and a center line in a longitudinal direction of the second inclined through groove intersect and form a V shape;

left and right ends of the pressing member are provided with a left connecting member and a right connecting member respectively;

the left connecting member and the right connecting member are arranged in a symmetrical manner;

each of the left connecting member and the right connecting member has a sideways U-shape;

the left snap-in portion of the left connecting portion of the two connecting portions and the right snap-in portion of the right connecting portion of the two connecting portions are connected to a middle portion of the left connecting member and a middle portion of the right connecting member respectively;

a left rotating shaft is inserted between the first inclined through groove on the inner and outer end surfaces of the pressing member;

both ends of the left rotating shaft penetrate corresponding first inclined grooves and are connected to both ends of the left connecting member respectively;

a right rotating shaft is inserted between the second inclined through groove on the inner and outer end surfaces of the pressing member; and both ends of the right rotating shaft penetrate corresponding second inclined grooves and are connected to both ends of the right connecting member respectively.

5. The easy-to-use foldable baby bed frame according to claim 1, wherein each of the two first support rods includes a first upper support rod and a first lower support rod;

a bottom portion of the first upper support rod is hinged to a top portion of the first lower support rod;

each of the two second support rods includes a second upper support rod and a second lower support rod; and a bottom portion of the second upper support rod is hinged to a top portion of the second lower support rod.

6. The easy-to-use foldable baby bed frame according to claim 5, wherein the bottom portion of the first upper support rod is provided with a left extending end portion oriented rightward;

a left end of the left extension end portion is provided with a left notch;

a first elastic member is provided inside an upper portion of the first lower support rod;

a top end of the first elastic member extends beyond the first lower support rod;

a right end surface of the first elastic member is provided with a left snap-in step snapping in the left notch;

a top portion of the first lower support rod is provided with a left hinge part hinged to the left extending end portion;

a first upper connecting rod is provided between the left extending end portions of the two upper support rods;

a first lower connecting rod is provided between bottom portions of the two first lower support rods;

a bottom portion of the second upper support rod is provided with an extended right end portion oriented leftward;

a right end of the right extending end is provided with a right notch;

a second elastic member is provided on an upper portion of the second lower support rod;

a top end of the second elastic member extends beyond the second lower support rod;

a right end surface of the second elastic member is provided with a right snap-in step snapping in the right notch;

a top portion of the second lower support rod is provided with a right hinge part hinged to the right extending end portion;

a second upper connecting rod is provided between the right extending end portions of the two second upper support rods;

the second lower connecting rod is provided between bottom portions of the two second lower support rods;

an inner side surface of the first lower support rod and an inner side surface of the second lower support rod are provided with a first driving member and a second driving member respectively; and the first driving member and the second driving member drive the first elastic member and the second elastic member to compress respectively.

* * * * *